United States Patent [19]

Seiki

[11] Patent Number: 4,960,542

[45] Date of Patent: Oct. 2, 1990

[54] LUBRICATING OIL COMPOSITION

[75] Inventor: Hiromichi Seiki, Ichihara, Japan

[73] Assignee: Idemitsu Kosan Company Limited, Tokyo, Japan

[21] Appl. No.: 423,603

[22] Filed: Oct. 16, 1989

Related U.S. Application Data

[63] Continuation of Ser. No. 183,744, filed as PCT JP87/00657 on Sep. 4, 1987, published as WO88/02020 on Mar. 24, 1988, abandoned.

[30] Foreign Application Priority Data

Sep. 8, 1986 [JP] Japan ..... 61-209635

[51] Int. Cl.[5] ..... C10M 105/32

[52] U.S. Cl. ..... 252/565; 202/56 R

[58] Field of Search ..... 252/565, 56 R

[56] References Cited

U.S. PATENT DOCUMENTS

| | | | |
|---|---|---|---|
| 3,640,858 | 2/1972 | Harr | 252/565 |
| 3,649,570 | 3/1972 | Boehringer | 252/565 |
| 3,962,071 | 6/1976 | Itoh et al. | 208/58 |

FOREIGN PATENT DOCUMENTS

| | | | |
|---|---|---|---|
| 1545400 | 1/1970 | Fed. Rep. of Germany . | |
| 2520459 | 11/1975 | Fed. Rep. of Germany | 252/565 |
| 7221151 | 1/1974 | France | 252/568 |
| 0036103 | 3/1977 | Japan | 252/565 |
| 27711 | 7/1985 | Japan . | |
| 161486 | 8/1985 | Japan . | |
| 866589 | 4/1961 | United Kingdom | 252/565 |
| 01182851 | 3/1970 | United Kingdom | 252/565 |
| 1460665 | 1/1977 | United Kingdom | 252/565 |
| 2134538 | 3/1986 | United Kingdom . | |

*Primary Examiner*—Olik Chaudhuri
*Assistant Examiner*—James M. Hunter, Jr.
*Attorney, Agent, or Firm*—Frishauf, Holtz, Goodman & Woodward

[57] ABSTRACT

The present invention provides a lubricating oil composition comprising 97 to 60% by weight of mineral oil and 3 to 40% by weight of polyester, said mineral oil having a kinematic viscosity of 100° C. of 2 to 50 centistokes, a pour point (as determined by JIS K-2269) of not more than −30° C., and a viscosity index (as determined by JIS K-2283) of not less than 70. This lubricating oil composition is suitably, used for lubrication of parts including a wet brake and a wet clutch, such as automatic transmissions and tractors.

The lubricating oil composition of the present invention has a suitable viscosity at high temperatures and further is low in low temperature viscosity.

Furthermore the lubricating oil composition of the present invention is excellent in friction characteristics, oxidation stability and also in seal rubber compatibility.

12 Claims, No Drawings

LUBRICATING OIL COMPOSITION

This application is a continuation of application Ser. No. 183,744, filed as PCT JP87/00657 on Sep. 4, 1987, published as WO88/02020 on Mar. 24, 1988 now abandoned.

FIELD OF TECHNOLOGY

The present invention relates to a lubricating oil composition and more particularly to a lubricating oil composition which is suitably used for lubrication of parts including a wet brake or a wet clutch of automatic transmissions and tractors.

BACKGROUND TECHNOLOGY

Lubricating oil for wet brake or wet clutch which is used in lubrication of parts including a wet brake or a wet clutch is required to be low in low temperature viscosity in view of starting performance. In general, the low temperature viscosity of lubricating oil can be easily decreased by decreasing the viscosity of the total base oil. In this case, however, the viscosity of the lubricating oil is too low at high temperatures, thereby producing a problem that the lubrication performance is decreased and the lubricating oil is unsuitable for practical use.

Therefore a method of compounding viscosity index improvers such as polymers to the low viscosity base oil has been widely used. This method, however, fails to solve the above problem because such polymers undergo viscosity reduction under shearing.

The first object of the present invention is to provide a base oil which holds a constant viscosity at high temperatures as one of the characteristics thereof and which is low in low temperature viscosity. It is, of course, required for the base oil to be excellent in oxidation stability and also in seal rubber compatibility.

The second object of the present invention is to provide a lubricating oil composition in which friction characteristics for wet brakes or wet clutches are increased by the base oil itself.

SUMMARY OF THE INVENTION

The present invention provides a lubricating oil composition comprising 97 to 60% by weight of mineral oil and 3 to 40% by weight of polyester, wherein the mineral oil has a kinematic viscosity at 100° C. of 2 to 50 centistokes (cSt), a pour point (as determined by JIS K-2269) of lower than −30° C. and a viscosity index (as determined by JIS K-2283) of at least 70.

The lubricating oil composition of the present invention has a suitable viscosity at high temperatures and further is low in low temperature viscosity.

Further, the lubricating oil composition of the present invention is excellent in friction characteristics.

In addition, the lubricating oil composition of the present invention is excellent in oxidation stability and also in seal rubber compatibility.

DETAILED DESCRIPTION

Mineral oil as the major component of the lubricating oil composition of the present invention has a kinematic viscosity at 100° C. of 2 to 50 cSt, preferably 5 to 30 cSt, a pour point of less than −30° C., preferably not more than −35° C. and more preferably not more than −40° C., and a viscosity index of not less than 70 and preferably 75 to 105. If the above physical values are not within the above defined ranges, the desired lubricating oil composition cannot be obtained.

Mineral oil having the properties as described above can be obtained by refining a distillate (boiling point under atmospheric pressure, about 250°–450° C.) as obtained by distillation of e.g., paraffin base crude oil or intermediate base crude oil, by the usual method and then applying deep dewaxing treatment.

The distillate means an oil obtained either by atmospheric distillation of crude oil or by vacuum distillation of residual oil resulting from atmospheric distillation of crude oil. A method of refining is not critical, and any of the methods (1) to (5) as described below can be employed.

(1) The distillate is subjected to hydrogenation treatment, or alternatively, after hydrogenation treatment, the distillate is subjected to alkali distillation or sulfuric acid washing (treating).

(2) The distillate is subjected to solvent refining treatment, or alternatively, after solvent refining treatment, the distillate is subjected to alkali distillation or sulfuric acid washing (treating).

(3) The distillate is subjected to hydrogenation treatment followed by second hydrogenation treatment.

(4) The distillate is subjected to hydrogenation treatment, then to second hydrogenation treatment, and further to third hydrogenation treatment.

(5) The distillate is subjected to hydrogenation treatment followed by second hydrogenation treatment, and further to alkali distillation or sulfuric acid washing (treating).

One of the methods will hereinafter be explained.

A crude starting material for lubricating oil is produced from paraffin base crude oil or intermediate base crude oil by the usual method and then is subjected to severe hydrogenation treatment. In this treatment, undesirable components, such as aromatics, for the lubricating oil fraction are removed or converted into useful components. Almost all of sulfur and nitrogen components are removed at the same time.

Such fractional distillation as to obtain the necessary viscosity is carried out by vacuum distillation. Then, the known solvent dewaxing treatment is carried out so as to dewax to the pour point that the usual paraffin base oil has, that is, about −15° to −10° C.

After the dewaxing treatment, if necessary, hydrogenation is carried out to hydrogenate the major portion of aromatic components into saturated components, thereby increasing thermal and chemical stability of the base oil. The pour point is still high, which is unsuitable for practical use. Thus, subsequently, deep dewaxing treatment is applied. For this treatment, there are employed a solvent dewaxing method which is carried out under severe conditions, and a catalytic hydrogenation dewaxing method in which a zeolite catalyst is used and paraffin (mainly n-paraffin) adsorbed on fine pores of the catalyst is selectively decomposed under hydrogen atmosphere to remove components to be converted into wax components.

Conditions for hydrogenation treatment vary with the properties, etc. of the feed oil. Usually, the reaction temperature is 200° to 480° C. and preferably 250° to 450° C., the hydrogen pressure is 5 to 300 kg/cm$^2$ and preferably 30 to 250 kg/cm$^2$, and the amount of hydrogen introduced (per kiloliter of the fed distillate) is 30 to 3,000 Nm$^3$ and preferably 100 to 2,000 Nm$^3$. In this hydrogenation treatment, there are used catalysts which are prepared by depositing catalyst components such as Groups VI, VIII group metals, preferably cobalt, nickel, molybdenum and tungsten on carriers such as alumina, silica, silica alumina, zeolite, active carbon and bauxite using the known method. It is preferred that the catalyst be previously subjected to preliminary sulfurization.

As described above, after hydrogenation treatment, the distillate is subjected to various treatments. When second hydrogenation treatment or further third hydrogenation treatment is applied, the treatment may be carried out under conditions failing within the ranges as described above. Conditions at the first, second and third stage hydrogenation treatments may be the same or different. Usually the second hydrogenation treatment is carried out under more severe conditions than the first stage hydrogenation treatment, and the third stage hydrogenation treatment, under more severe conditions than the second stage hydrogenation treatment.

Alkali distillation is carried out as a step where small amounts of acidic substances are removed to improve the stability of distillate. In this alkali distillation, alkalis such as NaOH and KOH are added and vacuum distillation is conducted.

Sulfuric acid washing (treating) is generally carried out as a finishing step of oil products, in which aromatic hydrocarbons, especially polycyclic aromatic hydrocarbons, olefins, sulfur compounds, etc. are removed to improve the characteristics of distillate. For example, 0.5 to 5% by weight of concentrated sulfuric acid is added to the distillate, the treatment is carried out at a temperature ranging between room temperature and 60° C., and thereafter neutralization using NaOH, etc. is applied.

The aforementioned methods (1) to (5) to be employed in treatment of distillate comprise combinations of the operations as described above. Of these methods, the methods (1), (3) and (4) are particularly suitable.

The mineral oil having the properties as described above can be obtained by subjecting the treatments described above to the base oil. Further, that mineral oil can be subjected to the clay treatment.

Polyesters which are used as the other component in the present invention include hindered esters and dicarboxylic acid esters.

Hindered esters having a pour point of not more than −30° C., preferably not more than −40° C. are used. Those having a pour point exceeding −30° C. are not preferred because they increase the low temperature viscosity. From viewpoints of kinematic viscosity, viscosity index and pour point, the following hindered esters are preferred.

Polyols in which the β-carbon of alcohol is quaternary, such as neopentyl glycol, trimethylolpropane, trimethylolethane and pentaerythritol are used as the polyol component constituting the hindered esters. As fatty acids which form hindered esters in combination with the above polyols, straight chain or branched fatty acids having 3 to 18 carbon atoms, and preferably 4 to 14 carbon atoms, especially branched fatty acids are preferred. Representative examples are straight chain fatty acids such as hexanoic acid, heptanoic acid, octanoic acid, nonanoic acid and decanoic acid, and branched fatty acids such as 2-ethylhexanoic acid, isooctanoic acid, isononanoic acid and isodecanoic acid.

In addition, mixed fatty acids composed mainly of fatty acids having 4 to 14 carbon atoms are preferred used. Because, these branched fatty acids and mixed fatty acids increase low temperature fluidity.

As dicarboxylic acid esters, those having a pour point of not more than −30° C., preferably not more than −40° C. are used. Dicarboxylic acid esters having a pour point of more than −30° C. are not preferred because they increase the low temperature viscosity. From viewpoints of kinematic viscosity, viscosity index and pour point, the following dicarboxylic acid esters are preferred.

Branched alcohols having 3 to 18 carbon atoms, especially 4 to 13 carbon atoms are preferred as the alcohol component to form dicarboxylic acid esters. Representative examples are isobutyl alcohol, isoamyl alcohol, isohexyl alcohol, isooctyl alcohol, isononyl alcohol, isodecyl alcohol and isotridecyl alcohol. As dibasic acids to form dicarboxylic acid esters in combination with the above alcohols, dibasic acids having 4 to 16 carbon atoms can be used. Representative examples are adipic acid, azelaic acid, sebacic acid and dodecane dicarboxylic acid.

The lubricating oil composition of the present invention comprises the aforementioned mineral oil and polyester. The lubricating oil composition comprises 97 to 60% by weight of mineral oil and 3 to 40% by weight of polyester, and preferably 90 to 70% by weight of mineral oil and 10 to 30% by weight of polyester. If the proportion of the polyester is less than 3% by weight, the effects resulting from addition of the polyester cannot be obtained. On the other hand, if the proportion of the polyester is in excess of 40% by weight, rubber swelling properties (seal rubber compatibility) and friction characteristics are undesirably decreased.

The lubricating oil composition of the present invention comprises the aforementioned components.

To the lubricating oil composition of the present invetnion, if desired, additives such as an antioxidant, a detergent-dispersant, a viscosity index improver, a defoaming agent, an extreme pressure agent and a pour point decreasing agent can be added. When the lubricating oil composition of the present invention is used as a lubricating oil for use in lubricating parts including a wet brake or wet clutch, a friction modifier such as reaction products of fatty acids and amines can be added thereto. As the antioxidant, those commonly used such as phenol base compounds, amine base compounds and zinc dithiophosphate can be used. Representative examples are 2,6-di-tert-butyl-4-methylphenol; 2,6-di-tert-butyl-4-ethyl-phenol; 4,4'-methylenebis(2,6-di-tert-butyl-phenol); phenyl-α-naphthylamine, dialkyldiphenylamine, zinc di-2-ethylhexyldithiophosphate, zinc diamyldithiocarbamate, and pinene pentasulfide.

Detergent-dispersants which can be used include an ashless base dispersant and a metal-based detergent. For example, alkenylsuccinic acid imide, sulphonates and phenates are preferred. Representative examples of such preferred compounds are polybutenylsuccinic acid imide, calcium sulphonate, barium sulphonate, calcium phenate, barium phenate and calcium salicylate.

Viscosity index improvers are not critical, and polymethacrylate, polybutene and so forth can be used as viscosity index improvers.

EXAMPLES 1 TO 6, AND COMPARATIVE EXAMPLES 1 TO 11

Mineral oils having the properties shown in Table 1 and polyesters having the properties shown in Table 2 were mixed in the fixed ratios shown in Table 3 to prepare lubricating oil compositions. These lubricating oil compositions were evaluated and the results are shown in Table 3. The testing methods are as follows.

[Testing Methods]

(1) Kinematic Viscosity
Measured according to JIS K-2283.
(2) Brookfield (BF) Viscosity
Measured accroding to ASTM D2983-80.
(3) ISOT (Test for Oxidation Stability of Lubricating Oil for Internal Combustion Engine)
Measured accroding to JIS K-2514, 3-1 (165.5°×48 hours)
(4) SAE No. 2 Friction Test
Friction characteristics were evaluated by the use of a SAE No. 2 friction tester (produced by Greening Co., U.S.A.) under the following conditions:

[Test Conditions]

Disc: Three paper discs for an automatic transmission made in Japan.
Plate: Four plates made of steel for an automatic transmission made in Japan.
Number of revolutions of motor: 3,000 rpm.
Oil Temperature: 100° C.

$\mu$1200 means a dynamic fraction coefficient at a number of rotations of 1,200 rpm and $\mu$0 means a static friction coefficient at the time that the motor is stopped.
(5) Aniline Point
Measured according to JIS K-2256.
(6) Seal Rubber Dipping Test
Measured accroding to JIS K-6301 under the following conditions.
Rubber: Nitrile rubber (A727 produced by Japan Oil Seal Co., Ltd.)
Oil Temperature: 150° C.
Test Duration: 170 hours

COMPARATIVE EXAMPLE 12

Commercially available paraffin-based solvent refining oils were evaluated in the same manner as in Example 1. The results are shown in Table 3.

TABLE 1

| | | Properties | | | |
|---|---|---|---|---|---|
| | | Kinematic Viscosity (@ 100° C., cSt) | Viscosity Index | Pour Point (°C.) | Remarks |
| Present Invention | Mineral Oil I | 2.36 | 75 | −47.5 | *1 |
| | Mineral Oil II | 5.65 | 89 | −45.0 | *1 |
| Comparison | Mineral Oil III | 4.00 | 95 | −17.5 | *2 |
| | Mineral Oil IV | 5.15 | 103 | −15.0 | *3 |
| | Mineral Oil V | 4.08 | −2 | −37.5 | *4 |
| | Mineral Oil VI | 9.00 | 43 | −25.0 | *5 |

*1 Mineral oil obtained in the following manner was used.
Kuwait crude oil was subjected to atmospheric distillation followed by vacuum distillation. A fraction resulting from deasphalting of the fraction and residual oil as obtained above was used as the feed stock and was subjected to hydrogenation treatment under such severe conditions that the viscosity index of the dewaxed oil product (after the first dewaxing treatment) reached 100.
The product obtained by the above method was fractionated to produce two distillates having viscosities at 100° C. of about 2.3 cSt and 5.6 cSt.
These two distillates were further subjected to solvent dewaxing treatment. Conditions for this treatment were such that the pour point of dewaxed oil was −15° C.
Then the above dewaxed oil was further subjected to hydrogenation treatment so that the aromatic content (as measured by the gel chromatograph method) was not more than 1.5% by weight.
Further the dewaxed oil which had been subjected to the above two stage hydrogenation treatment was subjected to solvent dewaxing treatment so that the pour point was not more than −35° C.
*2 Paraffin base solvent refined oil
*3 Paraffin base solvent refined oil
*4 Naphthene based oil
*5 Naphthene based oil

TABLE 2

| | Properties | | | |
|---|---|---|---|---|
| | Kinematic Viscosity (@ 100° C., cSt) | Viscosity Index | Pour Point (°C.) | Remarks |
| Polyester I | 4.3 | 142 | −50 | *1 |
| Polyester II | 3.48 | 162 | −70 | *2 |

*1 Unistar H-334R (produced by Nippon Yushi Co., Ltd.): Ester of trimethylolpropane and mixed fatty acids having 6 to 12 carbon atoms.
*2 DINA (produced by Sanken Kako Co., Ltd.): Adipic acid diisononyl ester

TABLE 3

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Composition (wt %) | Mineral oil I | 25 | 21 | 17 | 9 | 26 | 18 | 28 | — | — | — |
| | Mineral oil II | 63 | 55 | 71 | 67 | 69 | 45 | 72 | — | — | — |
| | Mineral oil III | — | — | — | — | — | — | — | 68 | 60 | 40 |
| | Mineral oil IV | — | — | — | — | — | — | — | 32 | 28 | 48 |
| | Mineral oil V | — | — | — | — | — | — | — | — | — | — |
| | Mineral oil VI | — | — | — | — | — | — | — | — | — | — |
| | Polyester I | 12 | 24 | — | — | — | 37 | — | — | 12 | — |
| | Polyester II | — | — | 12 | 24 | 5 | — | — | — | — | 12 |
| Additive *1 (parts by weight) | | 10.0 | 10.0 | 10.0 | 10.0 | 10.0 | 10.0 | 10.0 | 10.0 | 10.0 | 10.0 |
| Additive *2 (parts by weight) | | 5 | 5 | 5 | 5 | 5 | 5 | 5 | 5 | 5 | 5 |
| Results | Kinematic Viscosity (@ 100° C., cSt) | 6.98 | 7.01 | 7.00 | 6.99 | 6.99 | 6.96 | 6.91 | 6.97 | 6.94 | 7.00 |
| | BF Viscosity | 14800 | 12900 | 14000 | 9800 | 19200 | 13800 | 23800 | 36900 | 23100 | 22500 |

TABLE 3-continued

| | | | | | | | | | | | |
|---|---|---|---|---|---|---|---|---|---|---|---|
| | (@ −40° C., cp) | | | | | | | | | | |
| | ISOT | Kinematic Viscosity Ratio (@ 100° C.) | 1.15 | 1.12 | 1.17 | 1.08 | 1.19 | 1.11 | 1.27 | 1.52 | 1.31 | 1.27 |
| | | Increase in Total Acid Number | 0.53 | 0.58 | 0.49 | 0.44 | 0.50 | 0.62 | 0.48 | 7.37 | 5.39 | 4.31 |
| | SAE | μ1200 | 0.135 | 0.132 | 0.134 | 0.131 | 0.130 | 0.128 | 0.124 | 0.122 | 0.133 | 0.134 |
| | No. 2 | μ0/μ1200 | 1.06 | 1.07 | 1.06 | 1.07 | 1.05 | 1.09 | 1.04 | 1.05 | 1.08 | 1.09 |
| | Aniline Point (°C.) | | 92.2 | 84.0 | 93.0 | 84.0 | 97.3 | 80.0 | 101.3 | 95.0 | 86.9 | 89.0 |
| | Seal Rubber Dipping Test | Weight Change Ratio (%) | 3.2 | 4.1 | 3.0 | 4.1 | 2.6 | 5.9 | 2.0 | 2.7 | 4.0 | 3.8 |
| | | Volume Change Ratio (%) | 6.4 | 8.1 | 5.8 | 8.3 | 5.0 | 11.4 | 4.0 | 5.6 | 7.0 | 6.8 |

| | | | Comparative Example | | | | | | | |
|---|---|---|---|---|---|---|---|---|---|---|
| | | | 5 | 6 | 7 | 8 | 9 | 10 | 11 | 12 |
| Composition (wt %) | Mineral oil I | | — | — | — | — | — | 27 | 13 | Commercially Available Oil |
| | Mineral oil II | | — | — | — | — | — | 72 | 37 | |
| | Mineral oil III | | — | — | — | — | — | — | — | |
| | Mineral oil IV | | — | — | — | — | — | — | — | |
| | Mineral oil V | | 100 | 87 | 84 | — | — | — | — | |
| | Mineral oil VI | | — | 1 | 4 | — | — | — | — | |
| | Polyester I | | — | 12 | — | 100 | — | 1 | 50 | |
| | Polyester II | | — | — | 12 | — | 100 | — | — | |
| Additive *1 (parts by weight) | | | 10.0 | 10.0 | 10.0 | 10.0 | 10.0 | 10.0 | 10.0 | |
| Additive *2 (parts by weight) | | | 5 | 5 | 5 | 5 | 5 | 5 | 5 | |
| Results | Kinematic Viscosity (@ 100° C., cSt) | | 6.92 | 7.02 | 6.96 | 7.29 | 7.24 | 6.95 | 7.07 | 6.91 |
| | BF Viscosity (@ −40° C., cp) | | 78700 | 46300 | 40100 | 6460 | 1930 | 23300 | 9100 | 42000 |
| | ISOT | Kinematic Viscosity Ratio (@ 100° C.) | 1.93 | 1.91 | 1.81 | 1.09 | 1.05 | 1.25 | 1.08 | 1.32 |
| | | Increase in Total Acid Number | 6.70 | 6.45 | 6.21 | 0.49 | 0.71 | 0.48 | 0.65 | 1.20 |
| | SAE | μ1200 | 0.120 | 0.133 | 0.133 | 0.125 | 0.177 | 0.124 | 0.123 | 0.124 |
| | No. 2 | μ0/μ1200 | 1.06 | 1.07 | 1.09 | 1.10 | 1.12 | 1.05 | 1.10 | 1.31 |
| | Aniline Point (°C.) | | 76.3 | 70.6 | 73.8 | Not more than room temperature | Not more than room temperature | 100.5 | 71.0 | 95 |
| | Seal Rubber Dipping Test | Weight Change Ratio (%) | 9.7 | 11.3 | 10.8 | 16.3 | 24.1 | 2.2 | 11.0 | 2.8 |
| | | Volume Change Ratio (%) | 16.5 | 20.5 | 18.3 | 27.0 | 40.8 | 4.5 | 20.3 | 5.7 |

*1 Package type additive containing a detergent-dispersant, an antioxidant, a friction modifier, a defoaming agent and the like.
*2 Polymethacrylate type viscosity index improver The following can be seen from the result shown in Table 3. In comparative Examples 1, 2 and 5, the low temperature viscosities (@−40° C.) were 23,800 cp. 36,900 cp and 78,700 cp. respectively; that is, the requirment in practical use that the low temperature viscosity is not more than 20,000 cp is not satisfied. In Comparative Examples 2 and 5, an increase in total acid number of ISOT is large, showing that the deterioration is seriously large.

In Comparative Examples 3 and 4, and Comparative Examples 6 and 7, the total acid number of ISOT is large and further the low temperature viscosity is low. However, the requirement in practical use that the low temperature viscosity is not more than 20,000 cp is not satisfied. In Comparative Examples 8 and 9, the aniline point is low, and the weight and volume change ratios of rubber are large, demonstrating that the swelling and softening is large.

In Comparative Examples 10 and 11, the proportions are not within the range defined in the present invention. If the proportion of polyester is too small as in Comparative Example 10, the requirement in practical use that the low temperature viscosity (@−40° C.) is not more than 20,000 cp is not satisfied. On the other hand, if the proportion of polyester is too large as in Comparative Example 11, the aniline point is low and further the weight and volume change ratio to rubber is large, demonstrating that the swelling and softening is large.

If commercially available oil is used as in Comparative Example 12, the low temperature viscosity (@−40° C.) is 42,000 cp, which fails to satisfy the requirement in practical use. Furthermore, friction characteristics are not sufficiently satisfactory.

On the contrary, in Examples 1 to 6, the low temperature viscosity is not more than 20,000 cp, and oxidation stability (ISOT) and rubber swelling properties (seal rubber compatibility) are good. Furthermore, friction characteristics are excellent.

POSSIBILITY OF INDUSTRIAL UTILIZATION

The lubricating oil composition of the present invention is suitable as a lubricant additive for parts including a wet brake or a wet clutch. For example, it can be used as a lubricant additive for automatic transmissions fluid and a tractor oil. In addition, the lubricating oil composition of the present invention can be used as a power steering oil, a hydraulic oil or an internal combustion engine oil because it is low in low temperature viscosity and is good in oxidation stability and rubber swelling properties (seal rubber compatibility).

I claim:

1. A lubricating oil composition for a wet brake or wet clutch comprising 97 to 60% by weight of mineral oil and 3 to 40% by weight of polyester, said mineral oil having a kinematic viscosity at 100° C. of 2 to 50 centistokes, a pour point of lower than −30° C. and a viscosity index of at least 70, and wherein the polyester is a hindered ester or a dicarboxylic acid ester.

2. The composition as claimed in claim 1 wherein mineral oil has a kinematic viscosity at 100° C. of 5 to 30 centistokes.

3. The composition as claimed in claim 1 wherein the mineral oil has a pour point of not more than −40° C.

4. The composition as claimed in claim 1 wherein the mineral oil has a viscosity index of 75 to 105.

5. The composition as claimed in claim 1 wherein the mineral oil has a kinematic viscosity at 100° C. of 5 to 30 centistokes, a pour point of not more than −40° C. and a viscosity index of 75 to 105.

6. The composition as claimed in claim 1 wherein the polyester has a pour point of not more than −30° C.

7. The composition as claimed in claim 1 wherein the polyester is a dicarboxylic acid ester of $C_3$–$C_{18}$ alcohol and a $C_4$–$C_{16}$ dibasic acid.

8. The composition as claimed in claim 7, wherein said $C_3$–$C_{18}$ alcohol is isobutyl alcohol, isoamyl alcohol, isohexyl alcohol, isooctyl alcohol, isononyl alcohol, isodecyl alcohol or isotridecyl alcohol and said dibasic acid is adipic acid, azelaic acid, sebacic acid or dodecane dicarboxylic acid.

9. The composition of claim 7 wherein said alcohol is a $C_4$–$C_{13}$ alcohol.

10. The composition as claimed in claim 5 wherein the polyester is a dicarboxylic acid ester of $C_3$–$C_{18}$ alcohol and a $C_4$–$C_{16}$ dibasic acid.

11. The composition as claimed in claim 10, wherein said $C_3$–$C_{18}$ alcohol is isobutyl alcohol, isoamyl alcohol, isohexyl alcohol, isooctyl alcohol, isononyl alcohol, isodecyl alcohol or isotridecyl alcohol and said dibasic acid is adipic acid, azelaic acid, sebacic acid or dodecane dicarboxylic acid.

12. The composition of claim 10 wherein said alcohol is a $C_4$–$C_{13}$ alcohol.

* * * * *